US005555859A

United States Patent [19]

Melchior et al.

[11] Patent Number: 5,555,859

[45] Date of Patent: Sep. 17, 1996

[54] INTERNAL COMBUSTION ENGINES

[75] Inventors: Jean F. Melchior; Thierry Andre, both of Paris, France

[73] Assignee: S.N.C. Melchior Technologie, France

[21] Appl. No.: 302,007

[22] Filed: Sep. 7, 1994

[30] Foreign Application Priority Data

Sep. 13, 1993 [FR] France ..... 93 10853

[51] Int. Cl.[6] ..... F01L 1/28

[52] U.S. Cl. ..... 123/79 C; 123/90.14

[58] Field of Search ..... 123/79 R, 79 C, 123/65 VD, 90.12, 90.14

[56] References Cited

U.S. PATENT DOCUMENTS

| | | | |
|---|---|---|---|
| 2,484,923 | 10/1949 | Anderson . | |
| 2,979,046 | 4/1961 | Buchi | 123/79 C |
| 3,055,350 | 9/1962 | Buchi | 123/79 C |
| 4,449,490 | 5/1984 | Hansen . | |
| 4,539,950 | 9/1985 | Schaich | 123/79 C |
| 4,649,872 | 3/1987 | Solheim . | |
| 4,878,464 | 11/1989 | Richeson et al. | 123/90.14 |
| 4,991,548 | 2/1991 | Richeson et al. | 123/90.14 |
| 5,085,179 | 2/1992 | Faulkner | 123/79 C |
| 5,315,961 | 5/1994 | Wichelhaus | 123/90.12 |
| 5,335,633 | 8/1994 | Thien | 123/90.12 |
| 5,355,848 | 10/1994 | Denton | 123/79 C |

FOREIGN PATENT DOCUMENTS

| | | |
|---|---|---|
| 9008883 | 8/1990 | European Pat. Off. . |
| 1021442 | 7/1949 | France . |
| 1127166 | 7/1954 | France . |
| 1056872 | 5/1955 | Germany . |

*Primary Examiner*—Marguerite McMahon
*Attorney, Agent, or Firm*—Larson and Taylor

[57] ABSTRACT

Internal combustion engines with a cylindrical working chamber (1) in which there slides a piston (3), and which is closed by a cylinder head (4) with a device (5) for injecting atomized liquid fuel under high pressure and operating on the two-stroke cycle with a loop-scavenging system across the cylinder head, with two axisymmetric valves with coincident axes, one of these, an external, inlet valve (7) interacting with a seat (15) in the cylinder head and the other, an exhaust valve (6), exhibiting a tubular shape with a bearing surface applied against a seat (16) formed at the lower part of the inlet valve (7), the inlet valve opening towards the working chamber and the exhaust valve opening in the opposite direction, in order to delimit an exhaust passage (8) between them, the injection device (5) emerging in the working chamber substantially at the centre of a central hub (21) borne by the cylinder head and about which the exhaust valve (6) slides.

21 Claims, 6 Drawing Sheets

INTERNAL COMBUSTION ENGINES

The present invention deals with an improvement to internal combustion engines operating on the two-stroke cycle with injection of atomized liquid fuel under high pressure, such as two-stroke diesel engines. More particularly, the invention deals with a gases-exchange system incorporated exclusively into the cylinder head and intended especially to organize stratification between the combustion products of the preceding cycle and the fresh air introduced into the working chamber for the next cycle for the purpose of reducing heat losses to the walls and giving the conditions for a combustion process of a wholly remarkable quality while conserving excellent efficiency, termed scavenging efficiency, of the gas-exchange system.

A well known problem in compression-ignition two-stroke engines is that of increasing the effectiveness of the exchange of gases. What happens is that the replacement of the burnt gases by the charge of fresh air poses a specific problem, in the two-stroke internal combustion engine, because there is only a short amount of time (corresponding to an angle of rotation of the crankshaft of approximately 100° to 140° ) available for performing this whereas in an engine operating on a four-stroke cycle, the period of time available for this is substantially greater and may reach a duration corresponding to an angle of rotation of the crankshaft of approximately 400°. In two-stroke engines endeavours are generally made to improve the exchange of gases, a) by increasing the permeability of the cylinder, that is to say allowing the air flow rate required by the engine to pass through under the smallest possible pressure difference between the inlet and the exhaust;

b) by decreasing the short-circuit of air between the inlet and the exhaust by virtue of such an orientation of the current of fresh air entering the cylinder as to prevent it from passing directly from the inlet to the exhaust;

c) by preventing, as far as possible, the fresh air inlet into the cylinder from mixing, during scavenging, with the burnt gases coming from the preceding cycle and leaving the cylinder; and d) by creating intense air movements within the combustion chamber which are well synchronized with the injection of fuel in order to improve the mixing between air and fuel.

It would also be desirable to decrease, if possible, the motive power lost in actuating the valves, and especially the exhaust valves which must be lifted at a moment when the pressure of the motive gases in the cylinder is high.

Another factor in, decreasing the efficiency of an engine, especially a two-stroke engine, is linked to the area of the surface termed "wet surface". The wet surface is the internal surface of the volume where the start of the injection of fuel and the onset of combustion take place, which generally comprises the surfaces of the piston, the cylinder head, the valves and of that part of the cylinder which remains uncovered at top dead center. The wet surface effectively poses problems of cooling and energy losses.

A decrease in the surface of the combustion chamber has been sought, especially by French Patent No. 1,021,442. This patent describes an internal combustion four stroke diesel engine having at least-one cylinder with a reciprocating piston. The gaseous fluids are distributed to each cylinder by a pair of poppet valves, respectively an inlet valve and an exhaust valve, which are closed automatically by an individual antagonistic return spring. The valves are located coaxially inside one another in a way which is termed telescopic or concentric in the cylinder head of the associated cylinder and coaxially with this cylinder, so as to allow axisymmetric sweeping of the residual volume of the combustion chamber of the cylinder to be obtained close to top dead center of the piston. In other words, an axisymmetric configuration of the gaseous flow about the central longitudinal axis of the cylinder is achieved. The two valves open towards the inside of the associated cylinder and, during the sweeping phase, penetrate in simultaneously open positions into the combustion chamber proper which is made up of an appropriate bowl in the crown of the piston at top dead center of the latter. This configuration is perfectly suited to solving the problem of sweeping specific solely to the four-stroke operating cycle. The radially external valve is of open hollow annular shape. The radially internal valve interacts with a seat integral with the face under the head of the radially external valve, and the latter interacts with a stationary seat integral with the cylinder head.

The radially internal valve delimits an annular duct with and in the radially external valve. The radially internal valve is preferably used for exhaust, while radially external valve is used for inlet. The the opposite operational layout is equally well possible, but without affording the same advantages relating to the scavenging of the residual volume of the cylinder.

This prior document also discloses an internal combustion engine, for example a diesel engine, operating on a two-stroke working cycle and each cylinder of which includes one inlet valve located in the cylinder head above the cylinder and exhaust ports in the lower part of the lateral wall of the cylinder. A fuel injector may be provided in the cylinder head, being transversely oblique to the median longitudinal axis of symmetry of the cylinder or several such injectors may be provided, uniformly distributed around the combustion chamber of the cylinder.

In the case of the four-stroke cycle with concentric valves, each valve is actuated separately in terms of opening, in an independent manner via its own rocker against the antagonistic force of its own spring for automatic return to the closed position and during the individual opening movement of the radially external valve.

The patent FR-A-1,127,166 describes a specific form of hollow inlet valve for engines of this type.

Other devices reducing the wet surface are described in patents U.S. Pat. Nos. 2,471,509 and 2,484,923 which use, in two-stroke engines, two valves telescoped in one another and slide along the geometric axis of symmetry of the engine cylinder for axisymmetric flows of the gases. The peripheral valve, being made up in a substantially tubular fashion with one end curved radially outwards, forms a bearing surface interacting with a conical seat in the cylinder head. The central exhaust valve, in the form of a poppet valve, has its seat use an internal surface orientated towards the engine piston of the peripheral inlet valve so that both valves open towards the combustion chamber. The air inlet duct upstream of the inlet valve is set out with fins or deflection vanes so as to produce a swirling movement of inlet air which is intended to drop down along the wall of the cylinder then rise back up the center. The swirling air makes it possible to improve the mixing of fresh air and fuel by providing fuel injectors emerging into the peripheral part of the combustion chamber at an angle which is greatly inclined with respect to the radial direction. In this layout, the valves are dimensioned, shape and in terms of their lift, so that the passage offered to the fresh gases on inlet is distinctly greater than the passage offered to the combustion gases on exhaust.

These constructions however exhibit a certain number of drawbacks in so far as the exchange of gases is concerned. Thus, the flow of gases, particularly on exhaust, is not eased. The short circuit of air between inlet and exhaust is indeed partially decreased by virtue of the rotational movement given to the air in the direction of the cylinder. There nevertheless remains a preferred passage from inlet to exhaust by virtue of a short path which is orientated in a direction favourable to the escape of the gases. Scavenging moreover is designed so as to eliminate the combustion gases from the preceding cycle as much as possible. The lift of the central exhaust valve must be very substantial, during the scavenging phase, for an opening which offers only a small passage surface. Finally, injection takes place at the periphery directly into the swirling air which must therefore be at a sufficiently high temperature to bring about self-ignition. This has the effect of increasing the combustion temperature in an oxygen-rich medium promoting the formation of oxides of nitrogen.

The same is true in the old construction described in document DE-A-1,056,872, which produces a compact gas-exchange device by providing, within the cylinder head, an axisymmetric central hub capable of exhibiting a central injector or glow plug. A frustoconical seat for the lower end of a central tubular inlet valve is formed which delimits an air inlet passage between the hub and the tubular part of the valve which ends in a corresponding frustoconical bearing surface orientated towards the hub. This central valve is surrounded, with gliding, by a peripheral cylindrical exhaust valve. The frustoconical bearing surface is orientated radially externally towards a concentric seat in the cylinder head, and intended to evacuate the combustion gases via the periphery of the cylinder head.

An object of the invention is to improve the effectiveness of the exchange of gases by axisymmetrically driving out some of the residual burnt gases from the cylinder and replacing them with a corresponding volume of fresh air. This is done while preventing or reducing as far as possible any risk of fresh air passing directly from the inlet valve to the exhaust valve, or passing indirectly via the mixing of fresh air with the burnt gases leaving the cylinder, and with a minimum energy expenditure. The energy expenditure is minimized by researching the best possible use of the scavenging air supplied to the cylinder, but also by obtaining a high permeability. That is to say, producing maximum cross-sections for outflow offered to the gaseous fluids, thus requires only a relatively small pressure difference between the pressure of scavenging air and the exhaust backpressure in order to ensure a given scavenging air flow rate.

Another object of the invention is to ensure protection of the lateral walls of the working chamber by means of the centrifugal circulation of fresh air along these walls.

Another object of the invention is to minimize, in an engine establishing a high degree of stratification of gases within the wet surface of the cylinder. The wet surface is the internal surface bounded by the piston crown, possibly the upper part of the cylinder, and the whole of the internal surface of the cylinder head roof, in contact with the hot gases under pressure, which not only avoids poor combustion in the vicinity of the walls but also considerably limits the thermal losses and consequently gives rise to a substantial increase in the efficiency of the engine.

Another object of the invention is to reduce the load supplied to the means for controlling the exhaust valve while the pressure prevailing in the working chamber is high.

Another particularly important objective of the invention is to produce an engine with a considerably improved combustion phase by eliminating the conventional drawbacks of compression-ignition engines linked with the difficulties of obtaining both (1) complete combustion which is substantially exempt from unburnt matter and smoke, and (2) an absence of pollutants such as the oxides of nitrogen ($NO_x$).

In effect, it is known that in internal combustion engines of the type defined above, the fuel is injected under pressure into the combustion chamber when the piston is in the vicinity of top dead center (TDC), such as when the variable volume is in the vicinity of its minimum size. Adiabatic compression of the air trapped in the cylinder heats this air so that its temperature exceeds the self-ignition temperature of the fuel injected. The finely atomized fuel is introduced into the combustion chamber in the form of droplets. While penetrating into the ambient medium, each droplet vaporizes and the fuel vapour diffuses through this medium creating a zone where the fuel is spontaneous-ignition conditions are reached.

The time which elapses between the start of injection of the fuel and the onset of combustion, during each cycle, is called "the ignition lag". This first phase of the combustion is very abrupt: the fuel vapour premixed with the hot air (under the pressure and temperature conditions required for self-ignition), ignites en masse. The reaction rate is very high and, very soon, each partially vaporized droplet has consumed all of the oxygen present in the air which is mixed with the vapour. In such a short time, as the mixture is not homogeneous, the air which is not mixed in does not have time to sustain the combustion given its remoteness from the center (the droplet) of combustion. The reaction therefore very soon stops or at the very least slows down owing to the rarefaction of the available oxygen. This phase of combustion en masse (uncontrolled combustion) is called "pre-mix combustion".

The movements of air and fuel, which were pre-established or induced by the injection of fuel under high pressure or brought about by the expansion of the gases heated by the abrupt chemical reaction during this first phase of the combustion, allow the exothermic reaction to continue. This reaction then progresses in a controlled mode, by virtue of the transfers of mass by diffusion from the fuel-rich zones to the fuel-lean zones where the oxygen content is high. This phase of combustion by diffusion is termed "propagating flame-front combustion". It is much slower and progresses at the pace of the mixtures sustained by the relative movements of air and fuel in the working chamber.

The longer the ignition lag, the greater the amount of fuel injected before ignition, which gives rise to the following drawbacks:

abrupt combustion, whence noises (knocking of diesel engine) and vibrations created by the abrupt variation in pressure in the working chamber (giving rise to fatigue of the structures, slap and breaking of the piston rings); and formation of highly polluting oxides of nitrogen $NO_x$ (a significant amount of the $NO_x$ being formed in the zone where combustion develops as pre-mixed combustion and where high temperatures are maintained for a prolonged period).

The constructors of diesel engines have therefore endeavoured to reduce the ignition lag (for example by retarding the moment at which the fuel is introduced), while seeking to cool the fresh air inlet into the cylinder or cylinders so as to increase the density thereof and as far as possible so as not to exceed the cycle temperatures above which excessive quantities of the oxides of nitrogen are produced. Since this tends to increase the ignition lag. The solutions which they have proposed hitherto have not been entirely satisfactory, particularly from the point of view of the efficiency and of the emission of particles and smoke on exhaust.

The object of the invention is to solve, in an original way, the problem of shortening the ignition lag without thereby exceeding the cycle temperatures above which the production of the oxides of nitrogen becomes too significant. This not only solves the drawbacks recalled hereinabove, but also allows the burning of "cruder" fuels, which have a lower cetane number and are therefore less expensive to produce.

The subject of the invention is an internal combustion engine having at least one variable-volume working chamber delimited by a cylindrical wall in which there slides a piston, the moving upper face of the said piston and a stationary cylinder head.

The invention includes a device for injecting atomized liquid fuel under high pressure into the said working chamber operating on the two-stroke cycle, with a loop-scavenging system across the cylinder head, controlled by at least one inlet valve interacting with a seat, preferably a conical seat, so as to cause the working chamber to communicate cyclically with an inlet cavity communicating with the means for supplying the engine with fresh air, and at least one exhaust valve interacting with a seat, preferably a conical seat, so as to cause the working chamber to communicate cyclically with an exhaust cavity communicating with the system for exhausting the combustion gases from the engine.

The inlet inlet and exhaust valves are of axisymmetric shape and have coincident axes, preferably coincident with the axis of the abovementioned cylindrical wall, and are mounted coaxially such that the inlet valve is situated on the outside of the exhaust valve.

The abovementioned seat of the inlet valve is integral with the cylinder head and orientated such that the pressure of the motive fluid contained in the working chamber exerts a force which tends to press the valve onto its seat, and is situated in the immediate vicinity of the periphery of the upper part of the abovementioned cylindrical wall in which the piston slides, and is in contact with the cylinder head.

The elastic return means is provided for applying said inlet valve against the abovementioned seat integral with the cylinder head.

Means for generating a force are parallel to the axis of the inlet valve and point towards the piston and bear on the valve being provided for cyclically unseating the latter from its seat, making it possible to cause the working chamber of the engine to communicate with the inlet cavity communicating with the abovementioned means for supplying the engine with fresh air.

Rotation-inducing means are interposed between this inlet cavity and the seat of the inlet valve so as to give rise to an overall rotational movement of axis substantially coincident with the axis of the abovementioned cylindrical wall, of the air introduced into the working chamber during scavenging of the engine.

The exhaust valve is of axisymmetric shape and includes a lower part of tubular shape of which the internal wall slides, in a leaktight manner by virtue of sealing means, around a central hub borne by the cylinder head, and of which the lower part exhibits a bearing surface coaxial with the said tubular part, so that it can interact with a seat, preferably a conical seat, formed inside the lower part of the abovementioned inlet valve, thus making it possible to cause the abovementioned exhaust cavity to communicate with the working chamber by virtue of the annular space bounded radially by the inside wall of the inlet valve and by the outside wall of the exhaust valve.

Elastic return means are provided for applying the abovementioned bearing surface of the tubular lower part of the said exhaust valve against the seat formed at the lower part of the inside wall of the said inlet valve.

Means for generating a force are parallel to the axis of the exhaust valve and points towards the cylinder head away from the piston and and are on the said valve, being provided for cyclically unseating the latter from its conical seat making it possible to cause the working chamber of the engine to communicate with the abovementioned exhaust cavity communicating with the system for exhausting the combustion gases from the said engine.

The abovementioned device for injecting atomized liquid fuel under high pressure includes an injection nozzle which emerges into the working chamber substantially at the center of the abovementioned central hub borne by the cylinder head.

In a particular embodiment, the abovementioned central hub is stationary with respect to the cylinder head.

Advantageously, the minimum inside diameter of the abovementioned conical bearing surface orientated towards the outside of the tubular-shaped lower part of the exhaust valve interacting with a seat formed inside the lower part of the inlet valve, is less than the outside diameter of the sliding of the abovementioned sealing means of the central hub about which the inside wall of the tubular-shaped lower part of the exhaust valve slides in order to give it a slightly hermetically-sealed characteristic.

Various means for elastic return of the inlet valve and/or the exhaust valve may be provided. These means may especially include springs of mechanical type. These springs may be made up of a plurality of springs mounted like a barrel and exerting their return force on an annulus integral with the upper part of the valve.

It is also possible to provide, or to associate with the return means, such as the springs, means for elastic return of the inlet valve and/or the exhaust valve which include a piston integral with the valve and sliding in a cylinder delimiting a variable-volume cavity communicating with means for generating a fluid pressure.

In order to actuate the exhaust valve and/or the inlet valve in the opening direction, it is possible to render a piston integral with the valve. This piston slides in a cylinder delimiting a first variable-volume cavity communicating with means generating fluid pressure. Because the fluid is preferably substantially incompressible.

The means for generating fluid pressure may, for example, be made up of a piston sliding in a cylinder forming a second variable-volume cavity communicating with the abovementioned first cavity. The piston is actuated by a motive means such as camshaft rotating in synchronism with the engine output shaft.

The pistons for returning the valve and actuating it in the direction of opening it may be combined into one. The same piston has two faces so that the fluid pressures are then exerted on either of the said piston.

In a particularly advantageous embodiment, the engine piston bounds the working chamber of the engine by sliding in the wall of the cylinder. The engine piston is sealed with seals giving no passage for the motive fluid towards the lower part of the piston. The piston may be set out so that its upper part matches, with sufficient clearance to prevent the formation of radial air movements which could destroy the axisymmetric rotational movement of the motive fluid, that part of the cylinder head situated outside the maximum diameter of the inlet valve, and the inlet valve itself, when the volume of the working chamber is at a minimum. The minimum occurs when the cylinder is in the vicinity of top dead centre, and when that part of the cylinder head is situated outside the maximum diameter of the inlet valve and the inlet valve itself is delimiting a peripheral annular cavity in which there will be trapped a quantity of air in axisymmetric rotation which does not participate in the combustion of the fuel injected into the working chamber and which will expand during the stroke for increasing volume of the working chamber.

Advantageously, the means for sealing the inside wall of the tubular-shaped upper part of the exhaust valve sliding around the abovementioned central hub may include continuous seals giving no passage to the motive fluid compressed in the working chamber. The tubular-shaped lower part of the exhaust valve and the lower part of the central hub thus delimits an annular cavity in which there will be trapped a quantity of air which does not participate in the combustion of the fuel injected into the working chamber and which will expand during the stroke for increasing volume of the working chamber.

By virtue of the invention, it is possible to set out the dimensions, shapes, passage sections, pressures and partial vacuums and/or to actuate the timing means made up, especially, of the said valves, so that a significant amount of the combustion gases from the preceding cycle is retained in the working chamber during the process consisting of evacuating the combustion gases and replacing them in part with fresh air. This replacement is achieved opening the exhaust and inlet valves during the scavenging phase in the two-stroke engine.

The communication between the inlet cavity with the inlet valve in the open position and the walls of the working chamber are set out so that the flow of fresh air penetrates the combustion chamber. When the volume of the working chamber becomes minimal owing to the relative movement of the piston, this gives rise to an intense rotational movement of the working fluid inside the combustion chamber the centrifuging of the fresh air obtained by this rotational movement, and the difference in density between the fresh air and the combustion gases, prevents as far as possible, fresh air from mixing inside the combustion chamber with the combustion gases retained in the latter. This forms within the combustion chamber, a central zone where the concentration of the combustion gases and the temperature are at a maximum and a peripheral zone where the concentration of fresh air is at a maximum and the temperature is at a minimum.

By virtue of its central position in the hub, the injector may inject fuel directly into the abovementioned central zone, at least at the start of each injection period.

Preferably, the mass of combustion gases retained in the working chamber from one cycle to the next is at least equal to 10%, preferably to 15%, of the mass of the working fluid contained in this latter chamber at the moment at which the communications between the latter and each of the abovementioned inlet and exhaust cavities is broken during each cycle, while the engine is operating at least approximately at its nominal speed.

In this way, a combustion is organized in which the ignition lag is extremely short (even with the use of not very refined fuels, termed "cruder fuels"), or even zero. This is accomplished by a considerable increase in the temperature of the medium into which the fuel is injected so as to cause it to vaporize almost immediately. Nevertheless, the mean temperature of the working fluid is maintained at reasonable levels, which allows a high density and consequently high specific power and a low degree of production of oxides of nitrogen. Additionally, the superheated gaseous medium is kept away from the walls of the combustion chamber by the presence of an intermediate layer of fresh air. This prevents thermal overload of the engine and limits the losses at the walls.

It should be noted that the invention goes against the grain of the ideas generally adopted in the construction of diesel engines. The traditional endeavour to favour a maximum purity of the working fluid in terms of fresh air, rather than promoting relatively low purity (90%, or even 85%, or even less by mass), and inject the fuel into a zone where the concentration of combustion gases retained from one cycle to the next is at a maximum. It should be recalled that in a compression-ignition engine the combustion gasses still contain a sizeable proportion of available oxygen.

According to a particularly surprising improvement, the temperature of the inlet air and the proportion of gases retained in the working chamber from one cycle to the next are chosen so that if one were to mix the retained gases and the fresh air before injecting the fuel, the temperature of the mixture thus obtained at the moment of injection could be less than that at which self-ignition of the fuel takes place without producing excessive unburnt matter. This improvement has the advantage of making it possible both to cool the fresh supply air intensely (in order to limit the thermal loading on the walls and reduce the maximum temperatures of the cycle to temperatures below those which give rise to an excessive formation of noxious oxides of nitrogen) and having a reduced effective volumetric ratio (in order to limit the mechanical loading on the components), whilst conserving perfect self-ignition conditions with a short ignition lag.

It is also advantageous to choose the temperature of the inlet air and the proportion of gases retained in the working chamber from one cycle to the next, bearing in mind the other operating parameters of the engine, so that the maximum mean temperature of the working fluid does not exceed the value, on the order of 1500° C., above which the production of $NO_x$ becomes excessive.

Other advantages and characteristics of the invention will appear from reading the following description, given by way of non-limiting example, and referring to the appended drawings in which.

Figure 1:
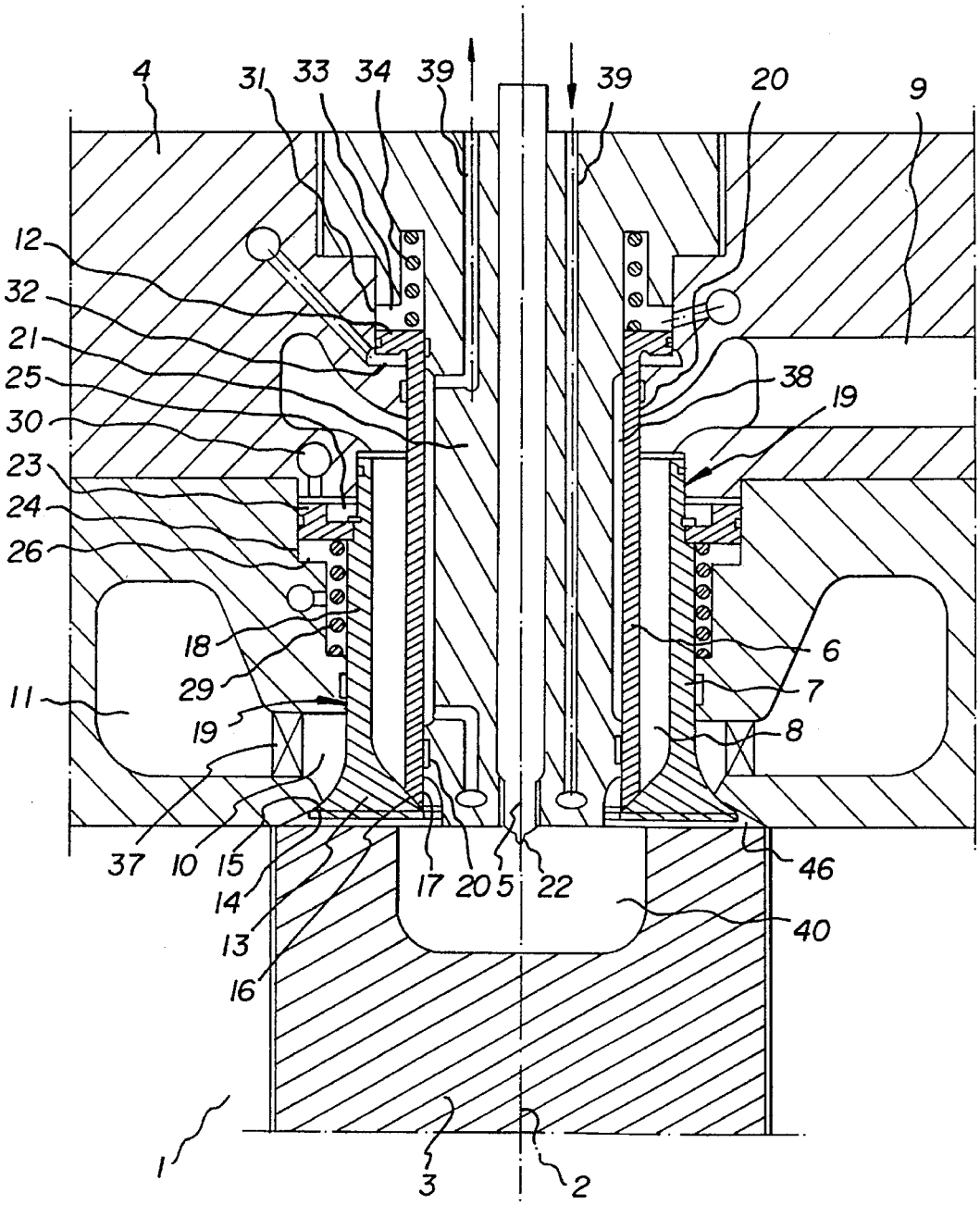
FIG. 1 represents a diagrammatic view in axial section of a part of an engine according to a first embodiment of the invention.

According to the embodiment represented in FIG. 1, the reference 1 denotes a cylinder of a two-stroke diesel engine of longitudinal axis 2 containing a piston 3 and the upper end of which is surmounted and closed by a cylinder head denoted in a general way by the reference number 4, including a central injector 5 for injecting liquid fuel under pressure. This is coaxial with the cylinder and coaxially surrounded by two concentric valves, respectively an internal exhaust valve 6 and an external inlet valve 7, delimiting a generally annular duct 8 between them for exhausting the burnt gases and which communicates with an exhaust pipe 9 connected to the exhaust system (not represented) of the engine.

The inlet valve 7 is of axisymmetric shape, hollow and open at each end, and of which the lower end 13 exhibits a sole shape and externally includes a sealing conical annular bearing surface 14 orientated outwards and upwards in the direction of the cylinder head, and interacting with a stationary seat 15 integral with the cylinder head 4, and internally includes a conical annular surface 16 orientated inwards and upwards, and acting as an axially mobile seat for a conjugate annular sealing bearing surface 17 located at the lower terminal part or free end of the exhaust valve 6. The inlet valve 7 is guided in its axial sliding by the external lateral wall of its tubular stem 18, in a valve guide 19 integral with the cylinder head 4.

The radially external inlet valve 7 delimits, together with the cylinder head 4, in its lower part situated in the immediate vicinity of its bearing surface interacting with the conical seat integral with the cylinder head, an annular inlet cutout 10 communicating with a pipe 11 for inlet of fresh air which pipe is connected to an inlet system (not represented) of the engine, for example a supercharging system.

The upper end of the stem 18 of the inlet valve 7 includes a collar 23 acting as an annular piston sliding in leaktight fashion in a coaxial cylinder 24 formed in the cylinder head 4, delimiting with the latter a chamber 25 on the upper face of this piston, and a chamber 26 under the lower face of this piston.

The radially internal valve or exhaust valve 6 has a substantially axisymmetric shape, an axis coincident with that of the inlet value and preferably coincident with the axis of the abovementioned engine cylinder 1, a tubular sleeve situated inside the inlet valve 7 and slides axially via its internal lateral surface over a valve guide 20 forming part of a central hub 21 integral with the cylinder head 4. This central hub 21 moreover contains the fuel injector 5, of which the spray nozzle 22 emerges into the combustion chamber 40 in order to be able to inject therein jets of fuel which are substantially radial and preferably inclined and distributed in a star configuration about the nozzle.

The upper end of the tubular sleeve constituting the radially internal or exhaust valve 6 includes a collar 12 acting as an annular piston sliding in leak-tight fashion in a coaxial cylinder 31 formed in the cylinder head 4, together with the latter delimiting a chamber 32 under the lower face of this piston and a chamber 33 on its upper face.

The sealing between the external lateral wall of the tubular valve system 18 of the inlet valve 7 and the valve guide 19 integral with the cylinder head 4, on the one hand, between the internal lateral wall of the tubular sleeve of the exhaust valve and the valve guide 20 integral with the central hub 21, on the other hand, as well as the sealing between the abovementioned collars 12 and 23 acting as pistons and the cylindrical walls 24 and 31 formed in the cylinder head 4 is provided by a set of one or more annular seals, sealing rings or piston rings, which are preferably radially extensible.

The assembly constituted by the piston 23 of the inlet valve 7 and by the cylinder 24 constitutes a pressurized fluid actuator for actuating the valve 7 in the direction of opening lift (downwards, that is to say towards the piston 3). To this end, the upper chamber 25 of this actuator is intended to receive a pressurized hydraulic fluid, preferably one which is incompressible, such as oil which will additionally lubricate the gliding tracks of the seals in order positively to bring about the descent of the piston 23, therefore of the valve 7, into the open position, while the underlying lower chamber 26 contains elastic means 29 for returning the valve to the closed position.

These elastic return means may be made up of mechanical springs 29 comprising, preferably, a plurality of springs mounted in parallel like a barrel and angularly evenly distributed around the periphery of the collar so as to provide a uniform thrust over the whole of its perimeter. They may equally well or conjointly be made up of a pressurized fluid, preferably a compressible fluid, supplying the abovementioned lower chamber 26.

The generation of the hydraulic pressure in the upper chamber 24 of the abovementioned actuator may advantageously be achieved by causing the abovementioned chamber 24 to communicate, by virtue of the passages 30, with a pump cylinder (not represented) filled with incompressible hydraulic fluid and closed by a pump piston actuated by a cam shaft rotating in synchronism with the main shaft of the engine. It goes without saying that this pump piston may be actuated by any other known means such as an actuator which is controlled hydraulically, electromagnetically, or in some other way.

Similarly, the assembly constituted by the collar 12 acting as a piston for the exhaust valve 6 and of the cylinder 31, constitutes a pressurized fluid actuator for actuating the valve 6 in the direction of opening lift (upwards, that is to say away from the piston 3). To this end, the lower chamber 32 of this actuator is intended to receive a pressurized hydraulic fluid, preferably an incompressible fluid, such as oil, in order to bring about positively the rising of the piston 12, therefore the lift of the valve 6 into the open position, while the underlying lower chamber 33 contains means 34 for elastic return of the valve to the closed position. These elastic return means may, in the same way, be mechanical, hydraulic or preferably, and conjointly, pneumatic.

Between the annular inlet cutaway 10 and the fresh air inlet pipe 11 there are interposed deflector means 37 which are intended, when the inlet valve is lifted, to give the inlet air angular momentum capable of generating a rotational movement of axis substantially coincident with the axis 2 of the engine cylinder giving the fresh air streams penetrating into the working chamber a centrifugal helical path.

These deflector means may be made up of the shape of the inlet pipe. They may more simply be made up of vanes which are inclined with respect to the axis of the cylinder or more simply still by drillings uniformly angularly distributed over the periphery of the said annular inlet cutaway and of axes preferably perpendicular and none secant with respect to the axis of the said cylinder. This last configuration is particularly advantageous for facilitating the transmission to the cylinder head of the vertical loadings which are due to the pressure of the gases in the working chamber.

This configuration in the form of a tubular sleeve of the exhaust valve 6 is particularly advantageous in the sense that as opposed to a conventional poppet valve, the pressure of the gases prevailing in the working chamber at the moment of opening of the valve does not oppose this opening or opposes it very little: the force developed by the member for controlling the lift of the exhaust valve will consequently be reduced, which will facilitate production thereof. In particular, it is possible to use the exhaust valve control device without difficulty to achieve substantial engine braking. In effect, if a device for varying the valve-opening timing during operation of the engine is available, it is possible, by significantly anticipating the moment of opening of the exhaust valve at the beginning of the descending stroke of the piston (corresponding to the increase in volume of the working chamber of the engine) to cause the pressure prevailing in this working chamber to drop abruptly to correspondingly to reduce the positive work of the engine and consequently increase the engine braking. This early opening of the exhaust valve, while the pressure prevailing in the working chamber is very high, will be effortless owing to the tubular shape of this valve.

Finally, the particularly advantageous nature of the inlet and exhaust valves opening in opposite directions will be noted. In effect, when just -the exhaust valve is open (upwards) the pressure in the working chamber is high and evacuation of the combustion gases will take place naturally at high speed (supersonic puffs). In contrast, during the scavenging phase in the course of which the two valves are open simultaneously, so as to have maximum permeability allowing the pressure difference necessary between the inlet pipe 11 and the exhaust pipe 9 to be minimized, the travel of the inlet valve adding to that of the exhaust valve, the downward opening of the inlet valve considerably increases the passage cross-section offered to the exhaust gases, which will also facilitate production of its control member.

The peripheral inlet valve 7 is highly cooled by the inlet air during the scavenging phase. In contrast, in order to cool the tubular exhaust valve 6 and the central hub 21, provision may be made to give the external cylindrical surface of the hub a diameter which is sufficiently less than the internal diameter of the tubular valve 6 to create between the valve and the hub, except at the guide zones 20, an annular space 38 capable of having a cooling fluid, such as oil for example, running through it, which cooling fluid will additionally play a part in lubricating the gliding bearing surfaces of the seals provided in the guide zones 20. The cooling fluid will advantageously be introduced by virtue of outward and return ducts 39 which will irrigate the lower part of the central hub 21 in the vicinity of the tip of the injector 5 as a matter of priority and then, on the return circuit, will irrigate the annular space 38.

Apart from the natural protection of the lateral walls of the working chamber by means of the centrifuged fresh air introduced during the scavenging period of the engine, the axisymmetric arrangement of this chamber makes it possible to cause the air streams introduced to follow helical trajectories keeping them away from the central zone close to the exhaust for as long as possible and makes it possible to reduce as far as possible the mixing between the fresh air introduced and the combustion gases contained at the center of the working chamber. Thus a very high efficiency of the scavenging process is obtained, considerably reducing the short circuit either through direct passage from the inlet valve to the exhaust valve, or by mixing between the combustion gases leaving the working chamber and the fresh air introduced into the latter.

In the example represented, the piston 3 exhibits, in its upper face, an axisymmetric bowl 40, of axis coincident with that of the piston and which essentially constitutes the combustion chamber, while the volume of the working chamber is at a minimum, the piston being in the vicinity of top dead center.

The nozzle 22 for injecting liquid fuel under pressure, belonging to the injector 5, is situated substantially on the axis of the combustion chamber such that the fuel is injected, preferably in the form of inclined and evenly distributed radial jets, into the central part of the combustion chamber. Bearing in mind the geometric layouts adopted for the invention, the combustion gases retained in the working chamber at the end of the scavenging process, and therefore recycled, will be concentrated into this central zone of the combustion chamber, while the fresh air given substantial angular momentum during the inlet period, owing to the peripheral layout of the inlet valve 7 and the orientation of the air passages 37, will be contained by centrifugation at the periphery of the combustion chamber. The rotation of the air is maintained owing to the conservation of angular momentum during the rising stroke of the piston.

The amount of combustion gases at very high temperature and lean in oxygen, which are concentrated in the central zone of the combustion chamber may be obtained and adjusted easily. It is possible, for example, bearing in mind the inlet pressure in the inlet cavity 10 and exhaust pressure in the cavity 9, to give the passage cross-sections of the valves values such that some of the combustion gases have not been evacuated at the end of the scavenging phase when the two valves 6 and 7 close again. It is also possible to modify the speed and length of the helical path of the fresh gases. Another simple means is to cause the exhaust valve to close sufficiently early to trap some of the combustion gases.

By way of example, with a compression ratio of the order of 6 and a proportion by mass of 20% of combustion gases retained from one cycle to the next, the temperature of the central zone may be of the order of 1480° C. just before injection while the temperature of the peripheral fresh air in a rotational movement is of the order of 430° C.

Apart from this configuration offering natural protection of the lateral walls of the working chamber (lateral surface of the cylinder and of the combustion chamber) making it possible to reduce the thermal losses to the walls by a sizeable amount and therefore to improve the efficiency of the engine, it also exhibits, as regards the way in which combustion progresses, the following advantages:

the injection of the finely atomized liquid fuel into the very hot and oxygen-lean central zone gives rise to almost immediate vaporization and self-ignition of the fuel so as to bring the oxygen necessary for the combustion of the fuel inside two contra-rotating vortices generated by the injection of the fuel into the chamber under very high pressure, which can be noticed on observing an extremely low ignition lag. Since this combustion is initiated in a zone which is very rich (because very lean in oxygen) and very hot, the atoms of hydrogen and carbon combine with the available oxygen as a matter of priority, thereby preventing the formation of oxides of nitrogen despite the very high thermal levels reached at the end of compression at the heart of this central zone;

combustion continues in the peripheral zone which is very rich in oxygen and relatively "cold" owing to the centrifugal stratification of the fresh air introduced into the working chamber. It is observed that this combustion develops at a very high speed of reaction without, however, bringing about excessive formation of oxides of nitrogen owing to the low local thermal levels. The high reaction speed makes it possible, between the instant at which combustion is initiated and the instant at which the exhaust valve begins to open, to produce complete combustion without excessive emissions of unburnt matter, smoke, and noxious particles.

This configuration of the invention moreover exhibits embodiment details which may prove particularly advantageous. For example, the upper face of the piston 3 situated outside of the combustion chamber 40 is preferably flat and, with a clearance which will be determined so as to minimize the significance of the radial air movements when the piston is in the vicinity of its top dead center, will match the lower face of the sole 13 of the inlet valve 7. In doing so, when the piston is in the vicinity of top dead center, this upper face will trap a small annular volume 46 radially outside of the conical seat 15. If moreover the piston 3 is equipped with continuous seals of the sort described in patent FR-A-2,602, 827, it can be conceived that this small annular volume 46 constitutes a "cul-de-sac" in which there is set up upon each compression cycle of the piston, a reserve of fresh and rotating air which is sheltered-from the combustion of the fuel when the piston is in the vicinity of top dead center. When the piston begins its descending stroke, this reserve of air will expand, thus thermally protecting the upper crown of the piston 3 and the lower face of the sole 13 of the inlet valve 7 by developing a cold boundary layer.

Figure 2:
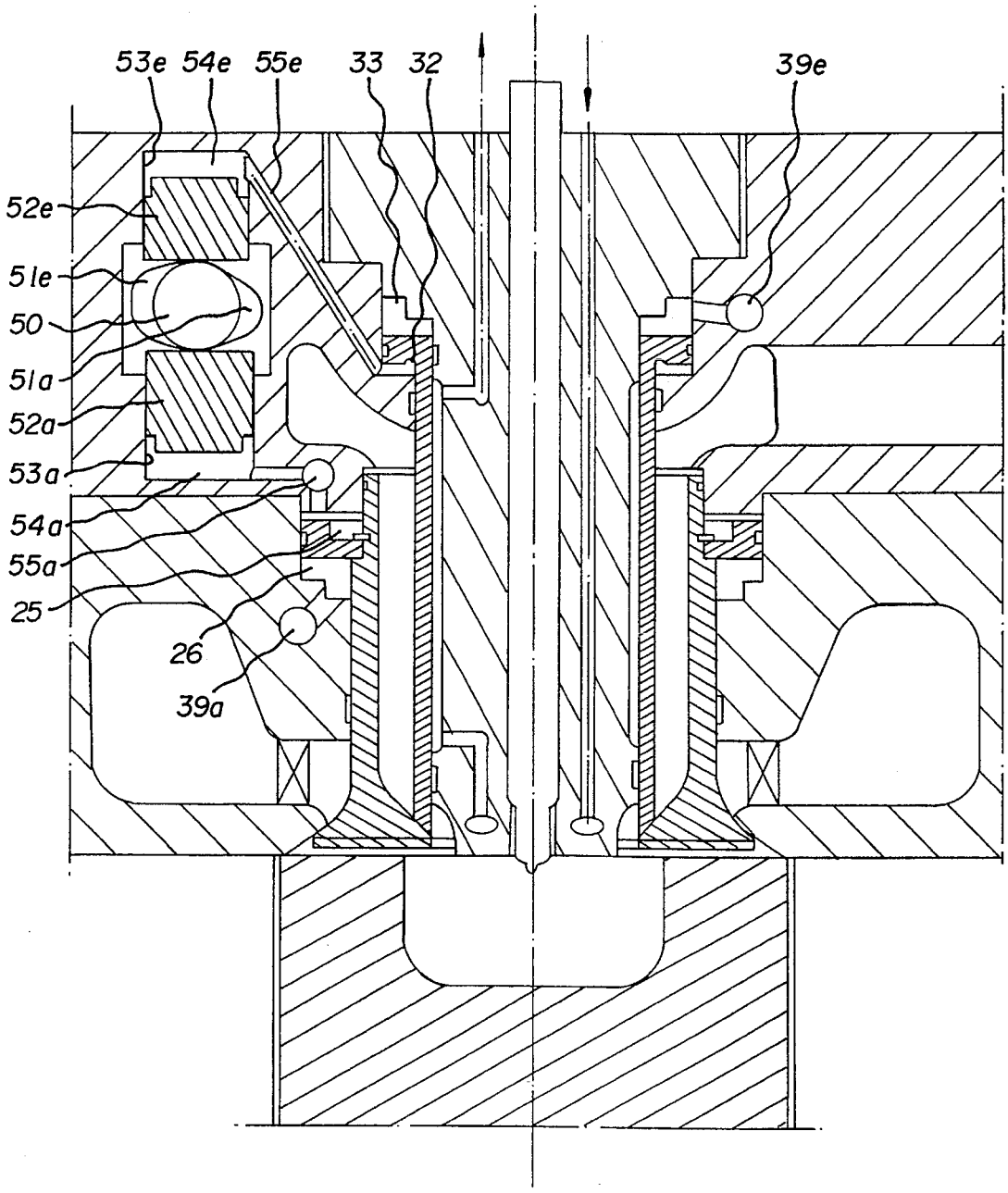
FIG. 2 represents a view in axial section according to a variant of this embodiment of the invention.

Referring now to FIG. 2, another embodiment of the invention can be seen which can be distinguished from the one represented in FIG. 1 by the fact that the means for elastically returning the inlet and exhaust valves are here purely pneumatic, the chambers 26 for the inlet valve and 33 for the exhaust valve communicating via passages 39*a* for the inlet valve and 39*e* for the exhaust valve with a cavity (not represented)- supplied with pressurized air.

For example, there is represented in this figure the means for generating vertical forces making it possible to lift the inlet and exhaust valves in order cyclically to unseat them from their respective seats. These means are essentially made up of a camshaft 50 rotating in synchronism with the main shaft of the engine and including an inlet cam 51*a* and an exhaust cam 51*e*. These cams actuate the pump pistons 52*a* and 52*e* sliding freely and axially in the pump cylinders 53*a* and 53*e*, thus delimiting variable-volume cavities 54*a* and 54*e* which communicate via passages 55*a* and 55*e* with upper cavities 25 of the actuator of the inlet valve 7 and lower cavities 32 of the actuator of the exhaust valve 6. All of these hydraulic circuits (54*a*, 55*a*, 25) and (54*e*, 55*e*, 32) are filled with an incompressible fluid such as oil. It will easily be understood that depressing each pump piston 52 by virtue of the action of the cam 51 will lift the corresponding valve to a travel equal to the travel of the cam multiplied by the ratio of the effective transverse sections of the pump piston and of the valve actuator. When the nose of the cam has passed beyond the angular position allowing the pump piston to be released, the means for elastic return of the corresponding valve will both return the valve to its seat and bring the pump piston back into contact with the cam.

Figure 3:
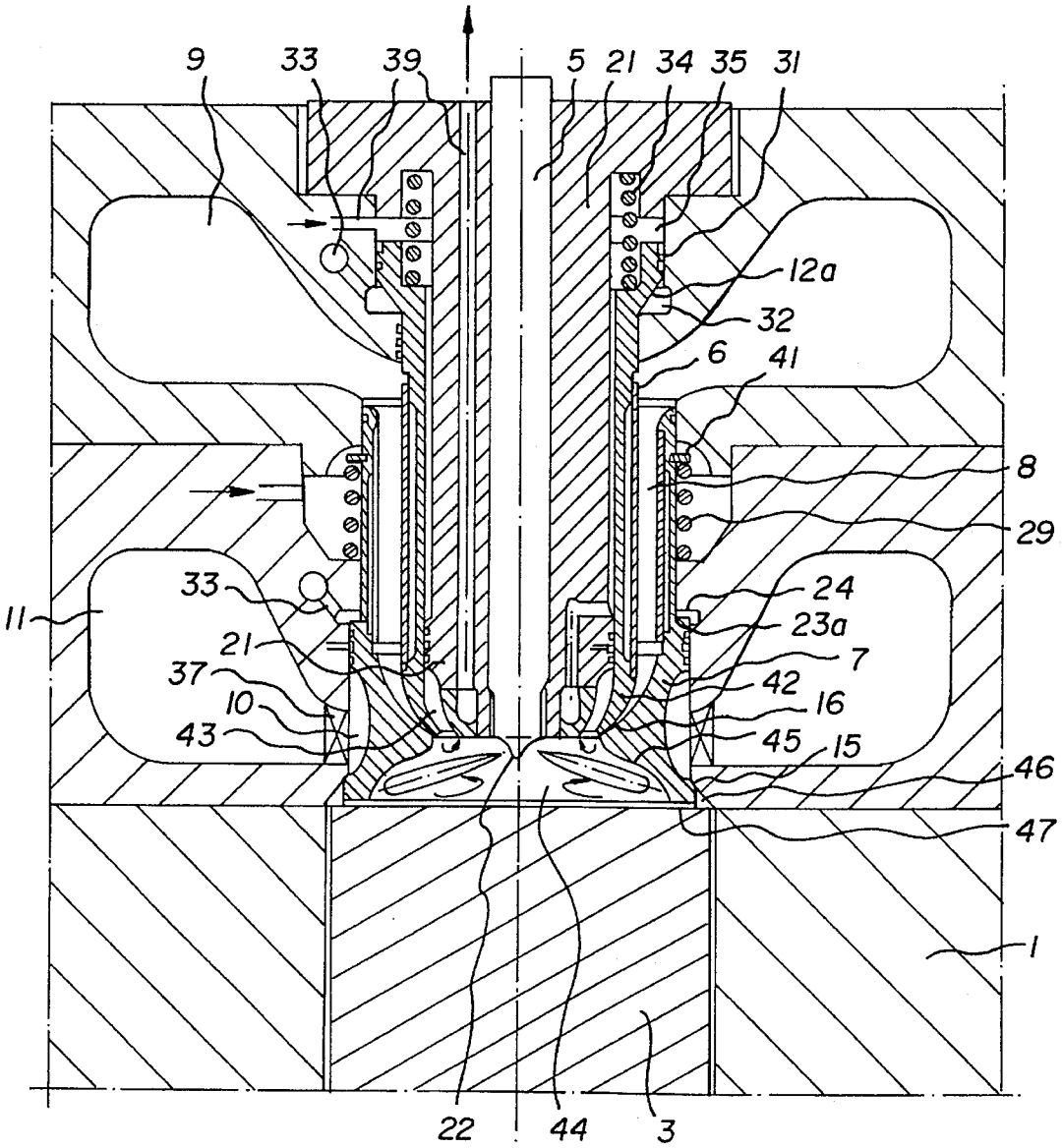
FIG. 3 represents a view in axial section of another embodiment of the invention.

Referring to FIG. 3, another embodiment of the invention can be seen which can be distinguished from the one represented in FIG. 1 firstly by a certain number of details. Thus, the cooling ducts 39 are laid differently. The annular inlet cutout 10 is formed in the external lower part of the inlet valve 7 and not in the cylinder head 4. The piston 23a of the external valve 7 is located in an intermediate position and the spring 29 urges upwards an annular ring 41 borne by the valve 7 in the vicinity of its upper end. The exhaust 6 and inlet 7 valves in their cylindrical part exhibit a double wall leaving a gap inside which may possibly have a cooling fluid running through it.

The advantageous aspect of this particular arrangement of the invention consisting in inclining the sole of the lower part of the inlet valve 7 and forming the annular inlet cutout 10 in the external part of this sole will be understood. In effect, it is seen that this layout, in which the seats 15 and 16 of the inlet and outlet valves are axially offset, makes it possible to site the annular duct for the exhaust gases above the abovementioned annular inlet cutout 10 and in doing so, makes it possible to offer a more substantial transverse section to the passage of the exhaust gases into the annular duct 8 (its mean diameter therefore being greater).

It will also be noticed that the annular air reserves formed at the periphery of the cylinder outside the conical seat of the inlet valve (annular reserve 46) on the one hand, and the one formed around the central hub 21 on the other hand, will, in expanding when the piston starts its descending stroke, supply the boundary layers of fresh air set in motion during injection, by virtue of the very high linear momentum transferred to the surrounding medium by the jets of fuel injected under very high pressure. These boundary layers thus drawn out will protect the walls of the combustion chamber and will "feed" the periphery of the fuel jets with fresh air so as to bring the oxygen necessary for the combustion of the fuel inside two contra-rotating vortices generated by the injection of the fuel into the chamber under very high pressure, thus facilitating mixing with the fuel and thereby the speed and quality of combustion.

The operation of the device according to the invention will now be described, in the embodiment of FIG. 3, with reference to FIGS. 4 to 6.

Figure 4:
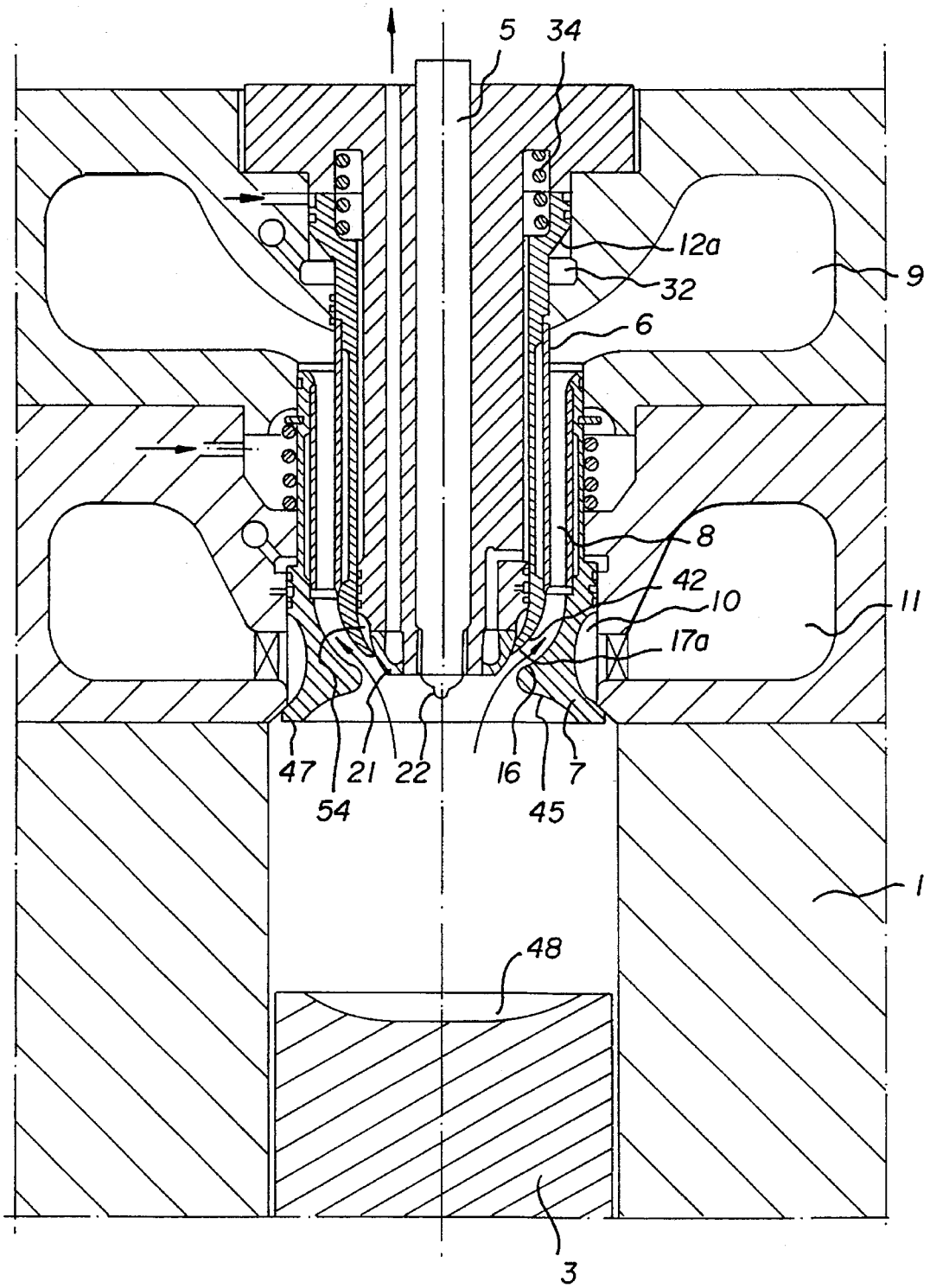
FIGS. 4, 5 and 6 represent views in axial section of a variant of the embodiment of FIG. 3 in exhaust, scavenging, and combustion positions, respectively.

In FIG. 4 the engine piston 3 has been represented in its bottom position, in the vicinity of bottom dead center, at the moment at which it starts to rise back up in order to reduce the free internal volume in the cylinder 1. At this moment, the control means (not represented) introduce pressurized hydraulic liquid into the chamber 32, which instantaneously causes the exhaust valve 6 to lift, on which valve the bearing surface 17a moves away from the seat 16 of the inlet valve 7 which has remained closed, placing the inside of the cylinder in communication via the duct 8 with the exhaust duct 9, while the return spring 34 of the exhaust valve is compressed. It is moreover seen that the lower curved part 42 of the exhaust valve has become substantially tangential to the lower convex end of the hub 21 so that the space 43 is substantially no longer in communication with the combustion chamber so that the exhaust gases flow out undisturbed. This outflow continues progressively as the piston 3 rises back up and drives out some of the combustion gases.

Figure 5:
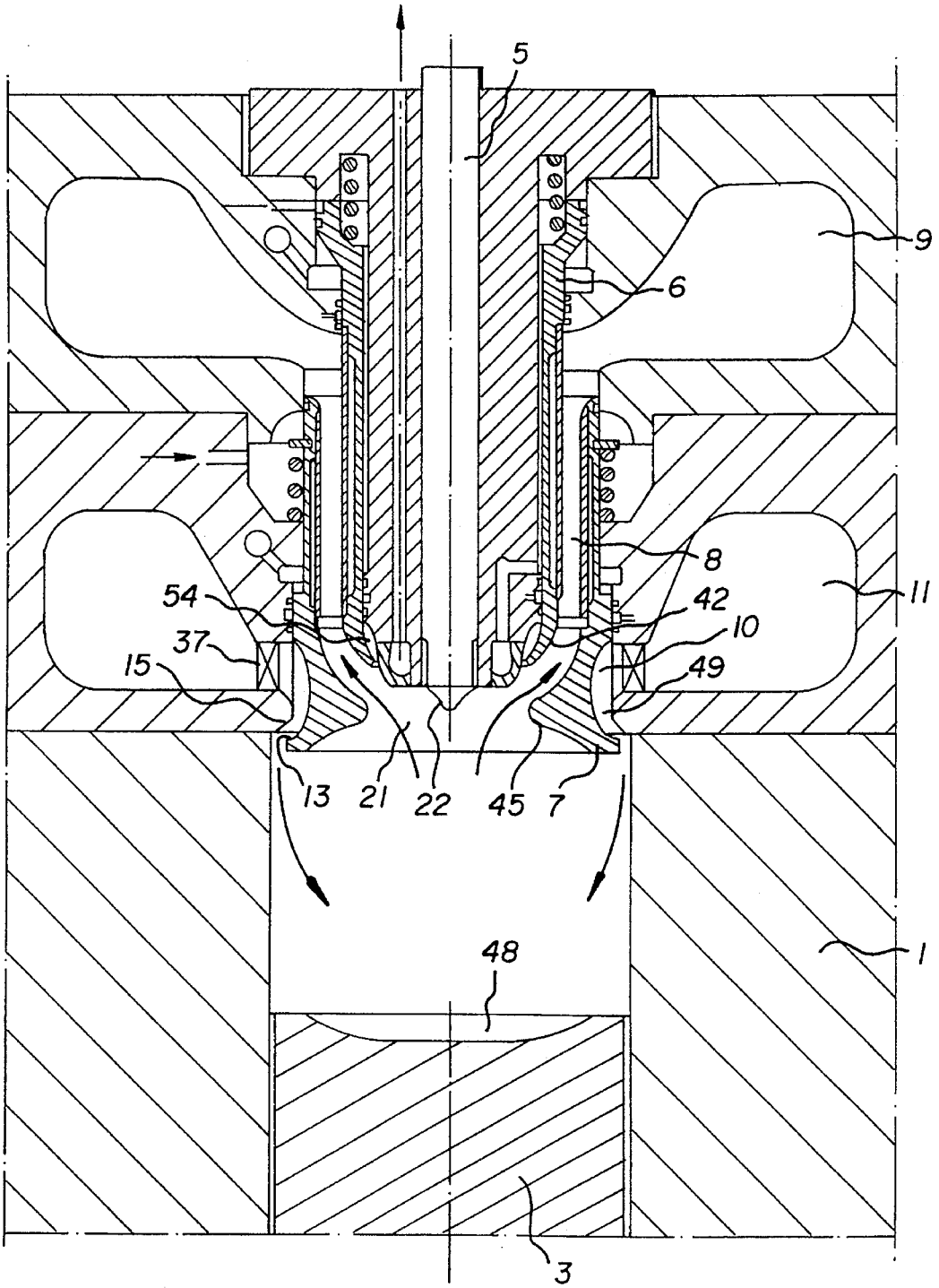
Figure 6:
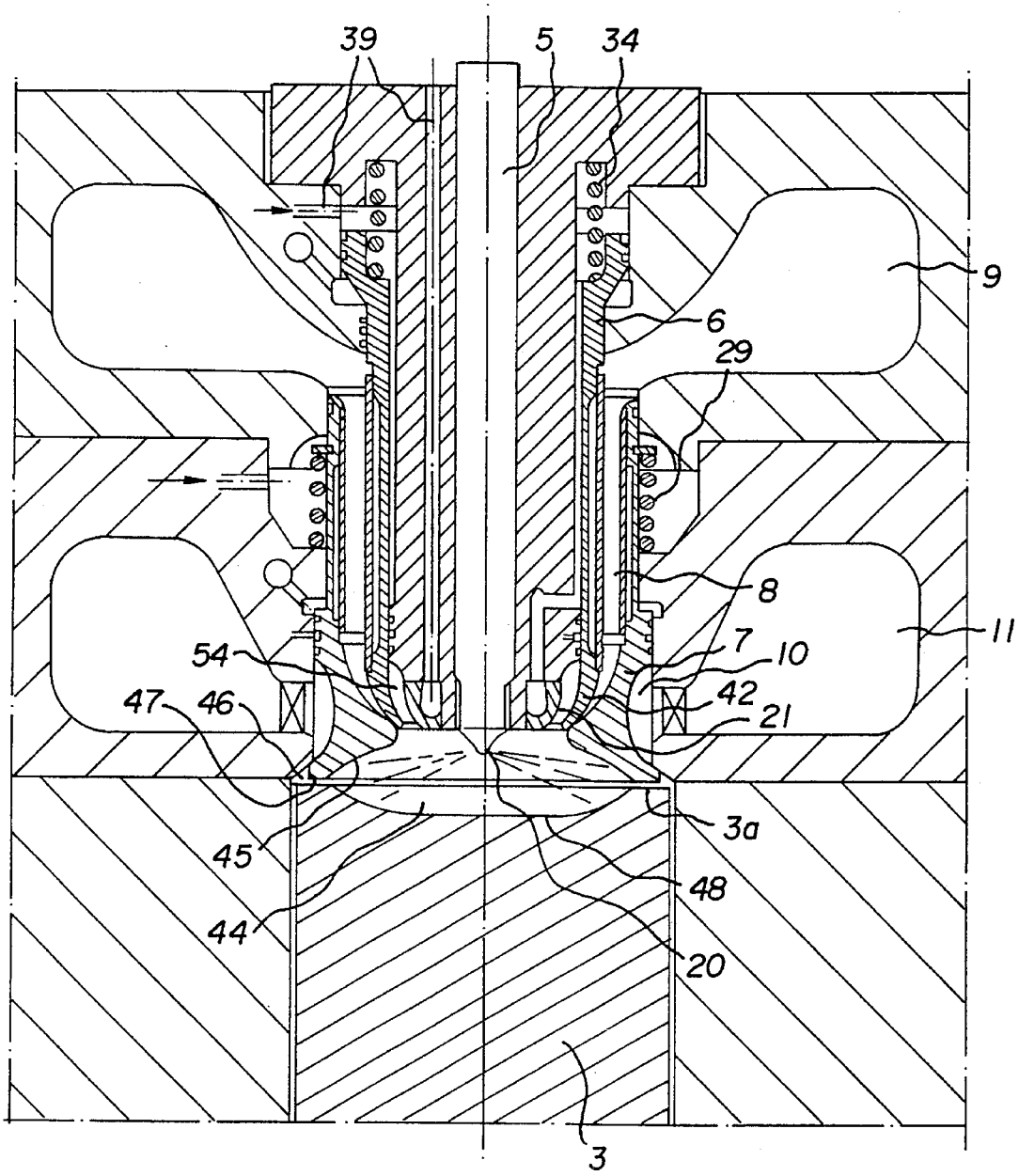

When the position represented in FIG. 5 is reached, the means for controlling the lift of the inlet valve 6 are actuated and the valve 7 drops down into the position represented in the figure. As the exhaust valve 6 remains in the raised position, the passage cross-section between the internal face, which bears the seat 16 of the valve 7 and the bearing surface 42 opposite of the valve 6 is greatly enlarged, which facilitates the continuation of the combustion gases leaving at a moment when the pressure in the cylinder has already dropped.

In parallel, the lowering of the valve 7 gives rise to the opening of the inlet passage, so that the annular cutout 10 is placed in communication with the inside of the cylinder via a passage 49 gradually orientating the air towards the lateral lower wall of the cylinder and towards the bottom by virtue of the concave curvature of the external surface of the inlet valve 7 at the region of the cutout 10, aided in doing so by the conicity or curvature progressing outwards and downwards, of the part of the cylinder head in the region of the external seat 14 of the inlet valve. The fresh air conveyed by the duct sweeps in through the deflector members 37 which impart a swirling rotational movement to it, which continues while the air drops down through the passage 49, the fresh air thus undergoing a centrifuging effect which keeps it substantially in the vicinity of the internal wall of the cylinder while it drops down towards the piston 3 so that the fresh air stays away from the internal part of the volume of the cylinder 1 and of the combustion chamber and contains within this part a residual quantity of hot combustion gases which are less rich in oxygen. Stratification of the gases, namely of the fresh air in a helical movement close to the wall of the cylinder and of the combustion gases containing a reduced quantity of air or oxygen and remaining at high temperature in the central part of the volume of the cylinder is thus obtained. This stratification remains substantially present as the volume decreases during the ascent of the piston 3, including after the inlet and exhaust valves have been closed again. This stratification persists still in the position represented in FIG. 6, close to top dead center, in which the volume is now limited to that of the combustion chamber 44, of which the volume of the bowl in the surface of the piston forms a part, the compressed fresh air rotating at the periphery of the combustion chamber while the hot gases which are leaner in oxygen remain contained in the central volume of the combustion chamber, that is to say in the vicinity of the central nozzle 22 of the injector. Towards the end of compression, the injector starts to atomize the liquid fuel as illustrated in FIG. 5 so that at the start of injection the liquid fuel is in contact with the hot gases of the central part of the volume where combustion commences, which combustion is thus carried out under the best possible conditions. Combustion then continues from the center towards the periphery in the direction of the fresh air, which produces practically perfect homogeneous combustion free of pollution and of the formation of oxides of nitrogen.

It is further understood that this combustion takes place under perfectly axisymmetric conditions in a combustion chamber volume of which the surface is minimal because it is reduced to the visible face of the hub 21, to the lower part of the internal surface of the inlet valve and to the surface opposite of the piston 3.

The rise in pressure due to combustion gives rise to the downwards power stroke of the piston 3 and the cycle recommences.

We claim:

1. Internal combustion engine comprising:

at least one variable-volume working chamber delimited by a cylindrical wall in which there slides a piston, the moving upper face of the said piston and a stationary cylinder head, means for injecting atomized liquid fuel under high pressure into said at least one working chamber, which operates on a two-stroke cycle, with a loop-scavenging system across the cylinder head, controlled by at least one inlet valve interacting with a seat, so as to cause the working chamber to communicate cyclically with an inlet cavity, wherein said inlet cavity communicates with the means for supplying the engine with fresh air, and at least one exhaust valve interacts with a seat, so as to cause the working chamber to communicate cyclically with an exhaust cavity, wherein said exhaust cavity communicates with the system for exhausting the combustion gases from the engine;

said inlet and exhaust valves being of axisymmetric shape and having coincident axes, preferably coincident with the axis of the abovementioned cylindrical wall, and mounted coaxially such that the inlet valve is situated on the outside of the exhaust valve, said seat of the inlet valve being integral with the cylinder head and orientated such that the pressure of the fluid contained in the working chamber exerts a force which tends to press said inlet valve onto its seat, and being situated close to the periphery of the upper part of said cylindrical wall in which the piston slides, and in contact with the cylinder head, elastic return means for biasing said inlet valve against said seat integral with the cylinder head, and means for generating a force which is parallel to the axis of the inlet valve and which points towards the piston, said force cyclically unseating said inlet valve from its seat, to cause the working chamber of the engine to communicate with the inlet cavity communicating with the means for supplying the engine with fresh air, rotation-inducing means interposed between said inlet cavity and said seat of the inlet valve so as to impart an overall rotational movement around an axis substantially coincident with the axis of the said cylindrical wall, to the air introduced into the working chamber during scavenging of the engine, and wherein the exhaust valve is of axisymmetric shape and includes a lower part of tubular shape which has an internal wall which slides, in a leaktight manner, by virtue of sealing means, around a central hub which is borne by the cylinder head, and wherein said lower part has a bearing surface coaxial with said tubular part, so that it can interact with a seat which is formed inside the lower part of said inlet valve, thus making it possible to cause the exhaust cavity to communicate with the working chamber by virtue of the annular space delimited radially by the inside wall of the inlet valve and by the outside wall of the exhaust valve, elastic return means being provided for applying the bearing surface of the tubular lower part of said exhaust valve against the seat formed at the lower part of the inside wall of the said inlet valve, and means for generating a force which is parallel to the axis of the exhaust valve and points towards the cylinder head away from the piston unseating said exhaust valve from its seat making it possible to cause the working chamber of the engine to communicate with said exhaust cavity communicating with the system for exhausting the combustion gases from said engine, and wherein said means for injecting atomized liquid fuel under high pressure includes an injection nozzle which emerges into the working chamber substantially at the center of the said central hub.

2. Engine according to claim 1, characterized in that the abovementioned central hub is stationary with respect to the cylinder head.

3. Engine according to one of claim 1, characterized in that the minimum inside diameter of the abovementioned bearing surface orientated towards the outside of said tubular-shaped lower part of the exhaust valve is less than the outside diameter of the central hub about which the inside wall of the tubular-shaped lower part of the exhaust valve slides.

4. Engine according to one of claim 1, characterized in that the means for elastic return of the inlet valve and/or of the exhaust valve includes spring means exerting return force on an annulus integral with the upper part of the valve.

5. Engine according to claim 1, characterized in that said means for elastic return of the inlet valve and/or of the exhaust valve include a piston integral with the valve and sliding in a cylinder delimiting a variable-volume cavity communicating with means for generating fluid pressure.

6. Engine according to claim 1, characterized in that the said means for generating a force which is applied to the exhaust valve and/or the inlet valve in the direction of opening the valve, include a piston integral with the valve, this piston sliding in a cylinder delimiting a first, variable-volume, cavity communicating with means for generating fluid pressure.

7. Engine according to claim 6, characterized in that said means for generating fluid pressure are made up of a piston sliding in a cylinder forming a second variable-volume cavity communicating with the abovementioned cavity, the piston being actuated by an activating means in synchronism with the engine output shaft.

8. Engine according to claim 4, characterized in that said piston for returning the valve and said piston for actuating it in the direction of opening it are combined into one and the same piston having two faces, the fluid pressures then being exerted on either side of the said piston.

9. Engine according to claim 1, wherein said piston, which delimits the working chamber of the engine by sliding in the wall of the cylinder is sealed with seals giving no fluid passage towards the lower part of the piston, and is constructed so that its upper part matches, with clearance, that part of the cylinder head situated outside the maximum diameter of the inlet valve as well as the inlet valve itself, when the volume of the working chamber is minimal, and wherein that part of the cylinder head situated outside the maximum diameter of the inlet valve and the inlet valve itself delimits a peripheral annular cavity which traps a quantity of air which does not participate in the combustion of the fuel injected into the working chamber and which expands during the stroke for increasing volume of the working chamber.

10. Engine according to claim 1, characterized in that the means for sealing the inside wall of the tubular-shaped upper part of the exhaust valve sliding around the abovementioned central hub include continuous seals giving no passage to the motive fluid compressed in the working chamber, the tubular-shaped lower part of the exhaust valve and the lower part of the central hub thus delimiting an annular cavity in which there will be trapped a quantity of air which does not participate in the combustion of the fuel injected into the working chamber and which will expand during the stroke for increasing volume of the working chamber.

11. Engine according to claim 1, characterized in that means are provided for circulating a heat-transfer fluid inside the central hub, these means being capable of cooling the inside wall of the tubular part of the exhaust valve.

12. Engine according to claim 11, characterized in that these abovementioned means for circulating a heat-transfer fluid are also capable of cooling the face of the central hub exposed to combustion in the working chamber of the engine.

13. Engine according to claim 1, characterized in that the variable-volume working chamber of the engine, while its volume is minimal, is essentially made up of an axisymmetric bowl inside the piston, the lower face of the inlet valve and that of the central hub being substantially planar and perpendicular to the axis of the piston.

14. Engine according to claim 1, characterized in that the variable-volume working chamber of the engine, while its volume is minimal, is essentially made up of an axisymmetric bowl situated inside the cylinder head and the lateral walls of which are made up of the annular head of the inlet valve, the upper face of the piston being substantially planar and perpendicular to its axis.

15. Engine according to claim 14, characterized in that the orifices of the fuel-injector nozzle are orientated in the direction of the abovementioned annular head of the inlet valve.

16. Engine according to claim 1, characterized in that the peripheral inlet valve has a lower end which is equipped, at its periphery, with an annular inlet cutout located facing inlet deflector means above the bearing surface interacting with the seat of the inlet valve, and in that the under surface of the lower part of the said exhaust valve is inclined such that said annular exhaust duct is situated above the said cutout and thus benefits from an increased passage cross-section.

17. Engine according to claim 1, characterized in that the gas distributor means are actuated such that a significant amount of the combustion gases from the preceding cycle is retained in the working chamber during the process consisting in evacuating the combustion gases and replacing them in part with fresh air, by opening the exhaust and inlet valves.

18. Engine according to claim 17, characterized in that the mass of combustion gases retained in the working chamber from one cycle to the next is at least equal to 10%, of the mass of the working fluid contained in said working chamber at the moment at which the communications between said working chamber and each of the abovementioned cavities is broken during each cycle, while the engine is operating at least approximately at its nominal speed.

19. Engine according to claim 17, characterized in that the temperature of the inlet air and the proportion of gases retained in the working chamber from one cycle to the next are such that if one were to mix the retained gases and the fresh air before injecting the fuel, the temperature of the mixture thus obtained at the moment of injection could be less than that at which self-ignition of the fuel takes place in a stable fashion without the production of excessive amounts of unburnt matter.

20. Engine according to claim 17, characterized in that the temperature of the inlet air and the proportion of the gases retained in the working chamber from one cycle to the next, are such that the maximum mean temperature of the working fluid does not exceed the value, above which the production of $NO_x$ becomes excessive.

21. Engine according to claim 17 wherein (1) the communication between the second cavity and the working chamber while the inlet valve is in the open position, and (2) the shape of the walls of the working chamber, are both constructed such that the flow of fresh air penetrates the combustion chamber while the volume of the working chamber becomes minimal because of the relative movement of the piston, thus giving rise to an intense rotational movement of the working fluid inside the combustion chamber and, by virtue of the centrifuging of the fresh air resulting from this rotational movement and by virtue of the difference in density between the fresh air and the combustion gases, preventing fresh air from mixing inside the combustion chamber with the combustion gases which are retained in the combustion chamber, a central zone where the concentration of the combustion gases and the temperature are at a maximum and a peripheral zone where the concentration of a fresh air is at a maximum and the temperature is at a minimum, and wherein the said means for introducing fuel under pressure are constructed so as to inject the fuel directly into the said central zone, at least at the start of each injection period.

* * * * *